US005226661A

United States Patent [19]

Wolf

[11] Patent Number: 5,226,661

[45] Date of Patent: Jul. 13, 1993

[54] METHODS OF APPORTIONING GAME WAGERS

[76] Inventor: Fred Wolf, 10418 Lubao Ave., Chatsworth, Calif. 91311

[21] Appl. No.: 988,724

[22] Filed: Dec. 10, 1992

[51] Int. Cl.[5] ..... A63F 1/00

[52] U.S. Cl. ..... 273/274; 273/292; 273/309

[58] Field of Search ..... 273/274, 292, 309

[56] References Cited

U.S. PATENT DOCUMENTS 4,659,078 4/1987 Shen et al. ..... 273/292

5,167,413 12/1992 Fulton ..... 273/274

OTHER PUBLICATIONS

Scarne's Encyclopedia of Games, Harper & Row Publishers, pp. 6–18 and 33–38, 1973.

*Primary Examiner*—Benjamin H. Layno

*Attorney, Agent, or Firm*—Timothy T. Tyson; Joseph Compton; Lawrence S. Cohen

[57] ABSTRACT

A method of apportioning wagers is disclosed which increases player interest and involvement in games where players successively become the "bank," i.e., wager against each of the other game players. The method offers the bank a plurality of wagering options. One of the options involves the bank with only those successive players whose combined wagers are less than or equal to the bank's wager while another of the options continues to involve the bank with successive players as long as his wager plus his winnings is not exceeded by his losses.

15 Claims, 3 Drawing Sheets

METHODS OF APPORTIONING GAME WAGERS

TECHNICAL FIELD

The present invention relates generally to games and more particularly to methods of apportioning game wagers.

BACKGROUND ART

Games having players successively designated as the bank are often played in cardrooms. The bank is a player who wagers against each of the other players for a number of game rounds, e.g., one or two rounds, after which the designation of the bank passes to the succeeding player. To facilitate play, the bank and the other players are generally arranged in successive order, e.g., clockwise about a game table, with a house supervisor situated in view of the players. If the game is one played with cards, the house supervisor typically deals the cards to the players. In exchange for the cardroom supplying the playing facilities, it is customary for the house supervisor to collect a fee from each player which may be a flat amount for each game play or, possibly, an amount based on elapsed time of play. Additionally, the house supervisor typically explains and administers the rules of the game in play.

SUMMARY OF THE INVENTION

The present invention is directed to methods of apportioning wagers between game players. The methods of the invention are especially suited for games in which players are successively specified to be a "bank" which wagers against each of the other players for one or more game rounds.

Preferred method embodiments in accordance with the invention are characterized by steps which offer the bank a plurality of wagering options for selection therebetween, followed by steps which implement the selected option. All wagering options include a step of physically providing wagers and a step of physically transferring amounts won and lost between game players.

The options include first and second wagering options on a first game round. The first wagering option is characterized by executing steps of matching different portions of the bank's wager against other players' wagers. The bank is involved in transferring wagers only with those successive players whose combined wagers are less than or equal to the bank's wager. In the first wagering option, the bank's win or loss are each limited to the bank's wager.

The second wagering option is characterized by executing steps of initiating a balance equal to the bank's initial wager and modifying this balance by adding the bank's wins and subtracting the bank's losses against successive players. The bank is involved in transferring wagers with successive players as long as the balance exceeds zero. In the second wagering option, the bank's win may be the accumulated sum of the wagers of all other players, while the bank's loss is limited to the bank's wager.

In a preferred method embodiment, the second wagering option includes, if the balance at the end of the first game round exceeds the bank's wager, the steps of executing a second game round wherein portions of the bank's wager are matched against other players' wagers and the bank is involved in transferring wagers only with those successive players whose combined wagers are less than or equal to the bank's wager. This embodiment may also include the step of requiring the bank's wager in the succeeding game round to at least equal the balance at the end of the first game round.

In a preferred embodiment, a third wagering option is offered the bank for selection thereof if the bank initially selected the first wagering option or if the bank initially selected the second wagering option and his balance at the conclusion thereof was less than his wager. The third option includes the steps of executing, on the succeeding game round, the steps of the first option.

In preferred method embodiments, the bank is offered the option of passing the specification of bank to the succeeding player.

Methods in accordance with the present invention may be practiced with any game having round sequences which determine a winner between a bank and other involved players and are especially suited for cardroom games such as Super Pan-9 and Asian Poker.

The novel features of the invention are set forth with particularity in the appended claims. The invention will be best understood from the following description when read in conjunction with the accompanying drawings.

MODES FOR CARRYING OUT THE INVENTION

Figure 1:
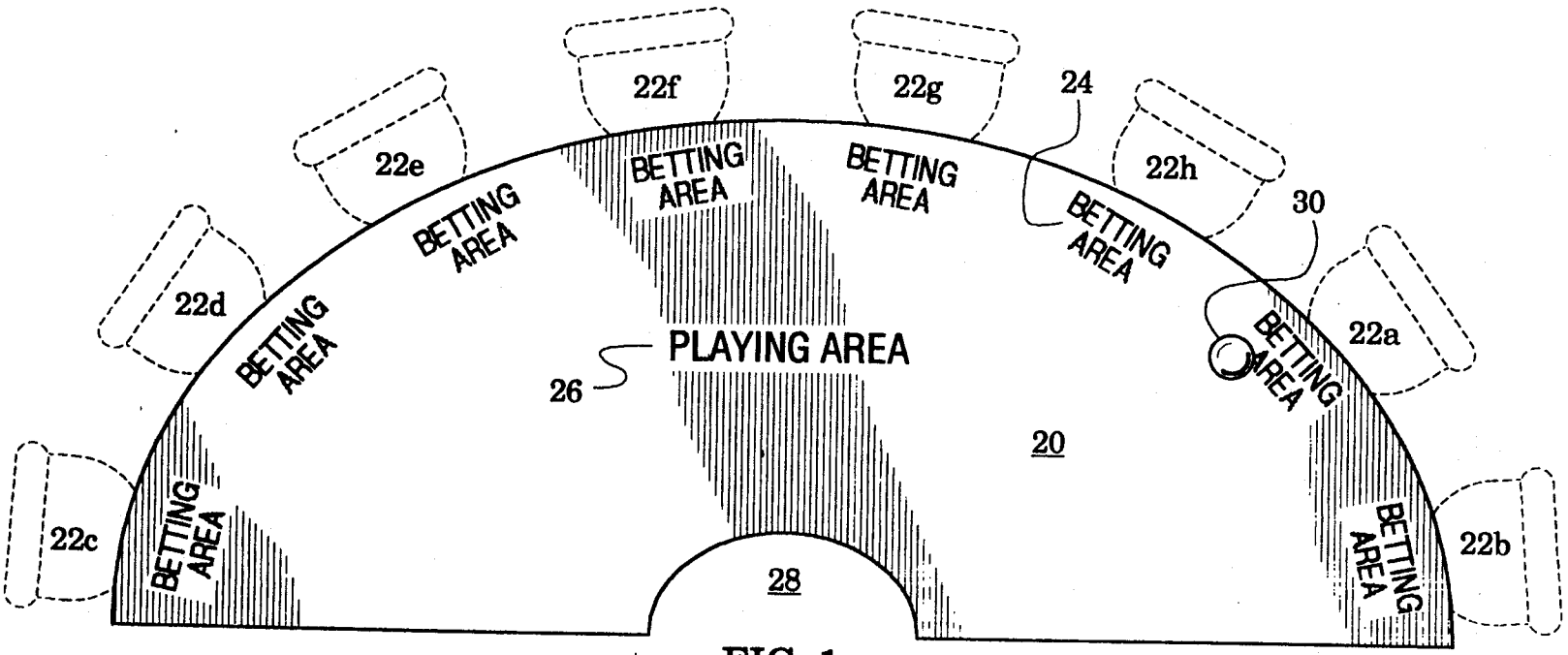
FIG. 1 is a plan view of a game table which may be used to practice a wager apportioning method in accordance with the present invention.

Attention is first directed to FIG. 1 which is a plan view of a game table 20 suitable for practicing a preferred embodiment, in accordance with the present invention, of a method of apportioning game wagers. The table 20 facilitates the arrangement of game players in successive order by seating them in chairs 22 about the table 20 where each chair is proximate to an associated betting area 24. The order of the positions is arbitrary but is established in advance of the game. For example, the players may be successively ordered in a clockwise arrangement, i.e. a player in chair 22*a* precedes one in chair 22*b*, while one in chair 22*c* succeeds that in chair 22*b* and so on.

Arrangement of players in successive order facilitates progression in games where one of the players is designated the "bank". The bank is a player who wagers against each of the other players for a number of game rounds, e.g., one or two rounds, after which the designation of the bank passes to the succeeding player. For example, if the player in chair 22*a* is the bank for a number of rounds set by the rules of the game in progress, then the player in chair 22*b* will be the next bank followed in succession by the player in chair 22*c* and so on. A game "round" refers to a game sequence which determines a winner between the bank and all other involved players, while a game "play" refers to a game sequence that determines a winner between the bank and one other player.

Games having players successively designated as the bank are often played in cardrooms where a house supervisor is situated in view of the players at location 28 defined by the game table 20. If the game is one played with cards, the house supervisor typically deals the cards to the players. He may place the bank's cards in a central playing area 26 while comparing them to each player's hand. In exchange for the cardroom supplying the playing facilities, it is customary for the house supervisor to collect a fee from each player which may be a flat amount for each game round or, possibly, an amount based on elapsed time of play. Additionally, the house supervisor typically explains and administers the rules of the game.

In accordance with the present invention, a method of apportioning (dividing and distributing according to a plan) wagers is provided which offers a plurality of wagering options to the game players. These options promote an increase in the number of players involved in each game round and the size of possible winnings. Consequently, the game becomes more exciting and enjoyable for the players and more profitable for the cardroom.

Figure 2B:
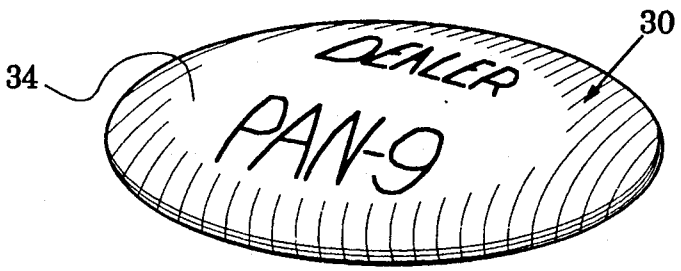
FIG. 2B illustrates a second face of the symbol of FIG. 2A.
Figure 2A:
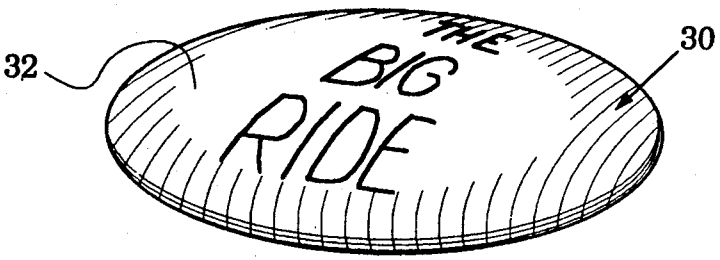
FIG. 2A illustrates a first face of a symbol which may be displayed in association with the present invention.

To identify the current bank and the wagering option chosen thereby, a symbol is placed proximate to the bank and oriented to indicate the chosen option to the other players. A preferred shape embodiment of this symbol is illustrated in FIGS. 2A, 2B to be a button shaped disk 30 bearing the indicia "The Big Ride" on one side 32 (FIG. 2A) and "Dealer Pan-9" on the other side 34 (FIG. 2B). Other indicia may be used as long as its association with wagering options is established prior to the game. It should be understood that the indicia may vary depending on the particular game in progress, i.e. the same option may bear different names in different games.

As mentioned above, the bank is a player who wagers against each of the other players for the duration of one or more game rounds. Typically, a round is initiated by the bank and other players each physically providing a wager. Winners are then successively determined between the bank and each of the other players, after which amounts determined by the method are physically transferred from losers to winners.

Figure 3:
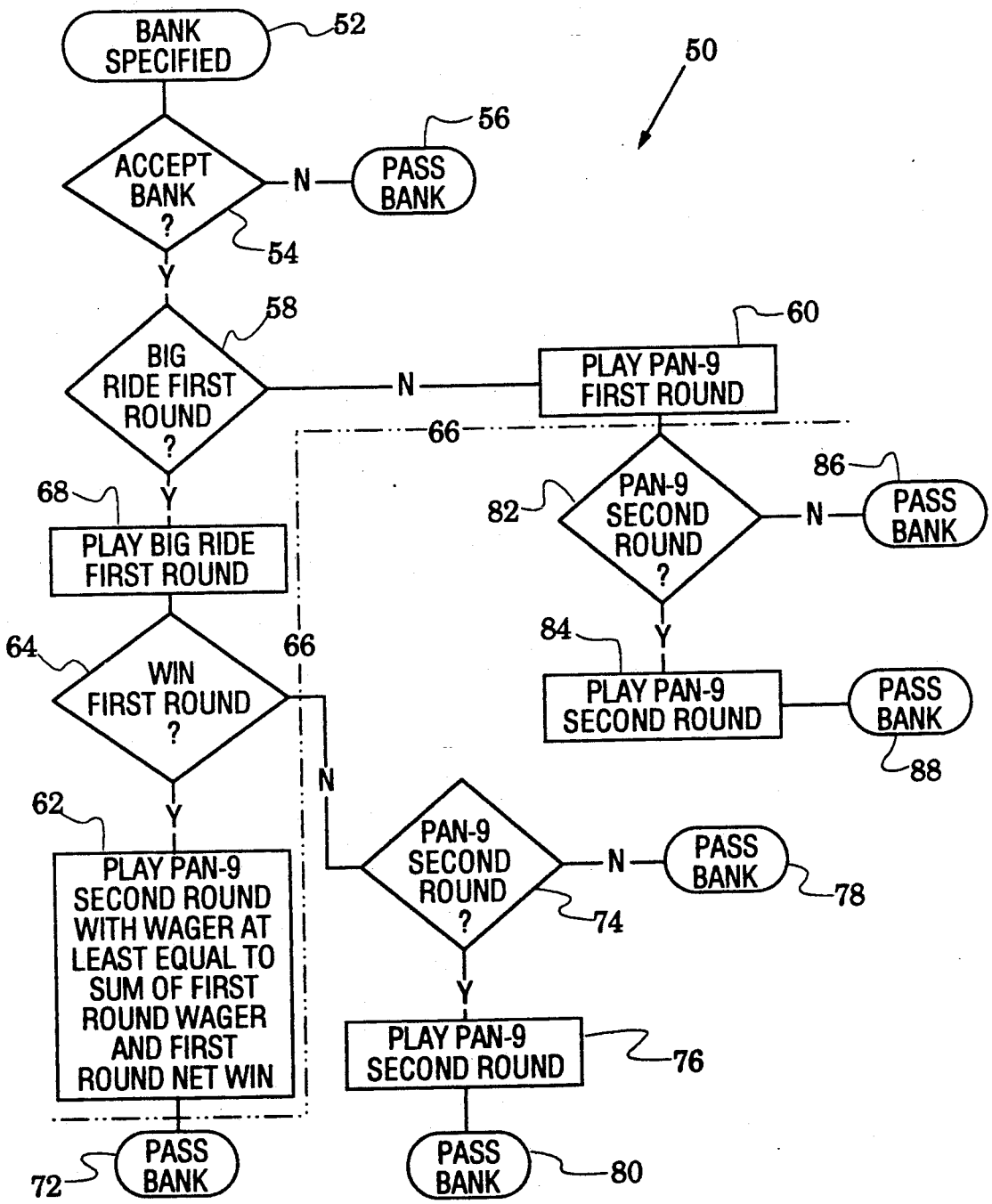
FIG. 3 is a flow chart illustrating a preferred embodiment of a wager apportioning method.

Attention is now directed to FIG. 3, which is a flow chart 50 illustrating a preferred method embodiment. The preferred method will be described generally in association with a card game, although it should be understood the teachings of the invention may be extended to any game that determines winners between players. In particular, the method will be described with reference to the card game "Super Pan-9," which is a game well known in California cardrooms. However, specific Super Pan-9 game rules are not part of the method and, therefore, will not be detailed herein.

The method begins in terminator 52 with the specification of one player as the bank. Selection of the bank is typically specified by the rules of the game being played, e.g., the house supervisor may select a card at random and match its numerical value to a seat around the game table. Once the first bank is specified, the bank usually successively passes around the table, e.g., in a clockwise direction.

The specified bank first makes decision 54, which is to accept the bank or pass the specification of bank to the succeeding player as shown by terminator 56. If the decision is to accept, the bank then must decide between first and second wagering options in decision 58, which asks if the bank wishes to play a "Big Ride first round". The decision at this point, once made, is especially important in that it may lead the bank all the way to one of two processes 60, 62. This is because the decision 64, leading to the process 62, is not under his direct control. The possible extent of the decision 58 is accordingly indicated by the broken line 66.

The preferred method description will first assume the bank chooses the first wagering option (rather than the second wagering option which relates to The Big Ride). He does this by declining to play a "Big Ride first round". Therefore, the method moves to process 60, which is to play a "Pan-9 first round".

The wagering process associated with this first option (which may hereinafter be referred to as a Pan-9 round) may be described with reference first to FIG. 1. Assume the bank is in chair **22*a*. In Super Pan-9, a second player known as "first action" is specified, e.g., by the bank rolling dice and the house supervisor counting the seats clockwise, starting with the bank as number one, until the number displayed on the dice is attained. If the player successive order is clockwise and if first action has been specified to be the player in chair 22*d*, then successive players are those in chairs 22*e*, 22*f*** and so on.

Figure 4:
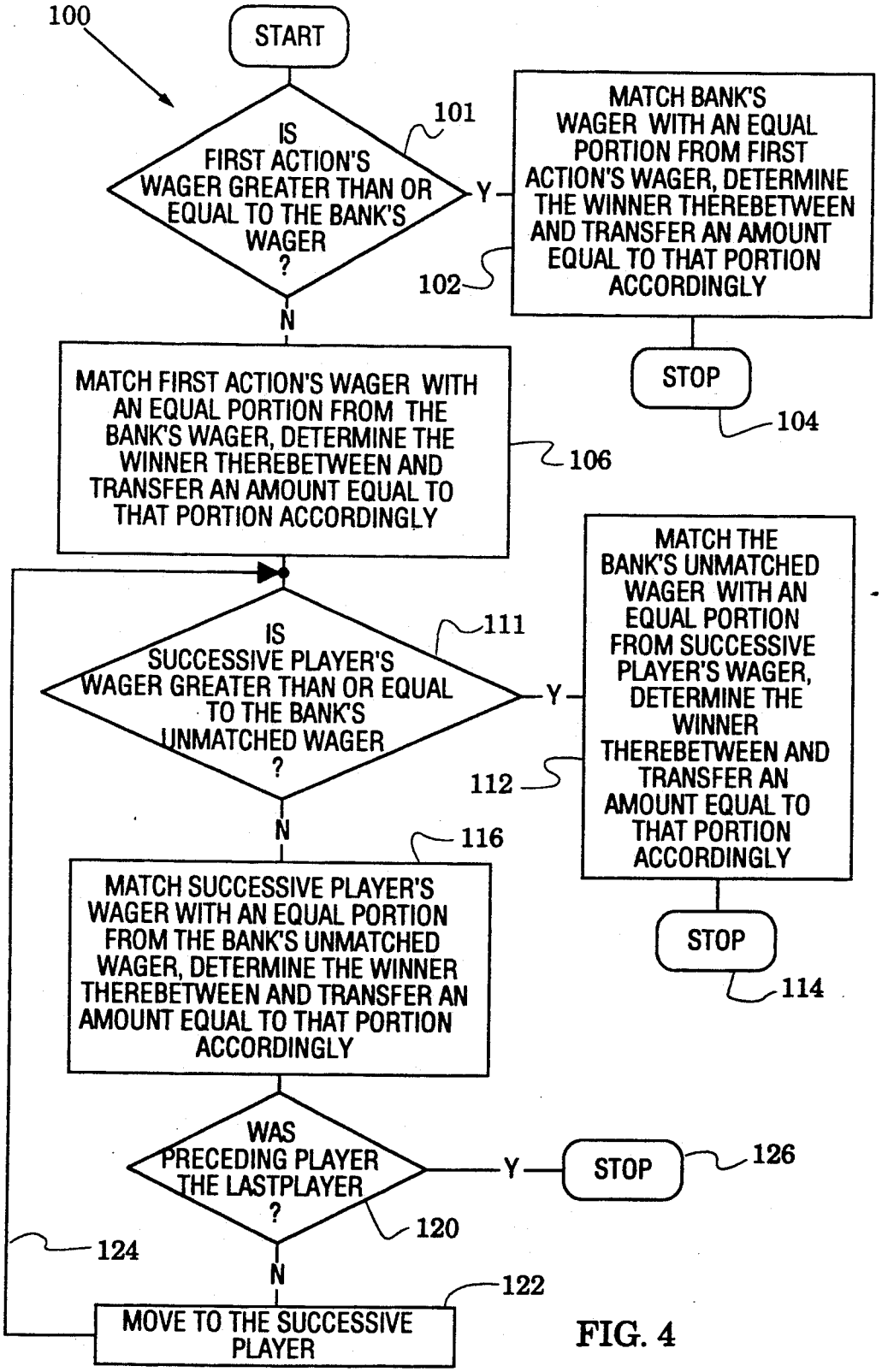
FIG. 4 is a flow chart illustrating a process of the flow chart of FIG. 3.

In a Pan-9 round, winners are determined and wagers transferred as shown in the flow chart 100 of FIG. 4, which details wagering process steps of process 60 of FIG. 3. If first action's wager is greater than or equal to that of the bank, the method moves from decision 101 to process 102, where the bank's wager is "matched" (placed in opposition) with an equal portion of first action's wager. In process 102, an amount equal to this portion is transferred from bank to first action if first action is the winner therebetween and from first action to the bank if bank is the winner therebetween. The wagering process then ends with terminator 104.

If first action's wager is less than the bank's, the method moves to process 106, where first action's wager is matched with an equal portion from bank's wager. An amount equal to this portion is then transferred to the winner in the manner described above.

Decision 111, process 112, terminator 114 and process 116 repeat the above described steps of decision 101, process 102, terminator 104 and process 106 with first action replaced by the successive player, i.e., the next clockwise player from first action, and with the bank's wager replaced with the bank's unmatched wager. That is, after first action's wager was matched by an equal portion of bank's wager in process 106, only bank's unmatched portion (bank's wager less first action's wager) is left for matching with the successive player.

Decision 111, process 112, terminator 114 and process 116 are continued with successive players as indicated by decision 120, process 122 and loop 124. It can be seen from these steps that if the bank's wager was greater than the combined wager of all other players, the steps end with terminator 126. In this case, loop 124 is followed for all successive players because bank's wager was sufficient to match the combined wager of all other players. Therefore, all players are involved in transferring of wagers at the end of the game round.

If the bank's wager was less than or equal to the combined wager of fewer than all of the other players, the steps end in terminator 114 because the steps of the method end when all of bank's wager has been exhausted in matching the wagers of successive players.

From the above, it may be seen that in a Pan-9 bank wagering process, determination of winners and transfer of wagers (or portions thereof) between the bank and other players involves those successive players, starting with first action, whose combined wagers are less than or equal to the bank's wagers.

For example, if the bank's wager is $50 and all other players wager $20, $20 of the bank's wager will be matched against first action, $20 against the first successive player and $10 of the bank's wager will be matched against the second successive player. These matched portions will then be transferred between the bank and these three involved players in accordance with determination of the winner in each case. No other players will be involved in transfer of wagers in this game round.

If a winner cannot be determined between the bank and a particular player because the game rules allow ties, no portion of the bank's wager is matched against that player and no wagers are transferred therebetween. Such a player is not involved in that round of the game and matching of wagers skips to the successive player.

The number of involved players in a specific game round, in addition to the bank, may therefore be as few as first action (i.e. one player) or as many as all other players. Since the process terminates when the bank's wager has been matched against other players' wagers, the bank may win or lose only as much as his wager.

Returning to flow chart 50, an affirmative answer at decision 58 indicates the bank has chosen a wagering process 68, which may hereinafter be referred to as playing a Big Ride round.

In a Big Ride wagering process, a winner is initially determined between first action and the bank, as is done in the Pan-9 wagering process described above. However, in a Big Ride, the bank's wins and losses are respectively added and substracted from the bank's wager to calculate a balance. For example, if the bank is the winner against first action, the balance is the bank's wager plus the amount won from first action. If the bank loses to the player who succeeds first action, the balance is then reduced by that loss.

In a Big Ride, the amount to be transferred to the winner between the bank and first action is the lesser of the bank's wager and first action's wager or an amount equal to either of them if they are identical. The amount to be transferred to the winner between the bank and the player succeeding first action is the lesser of the balance (after transfer of the amount between the bank and first action) and that player's wager or an amount equal to either of them if they are identical. This process continues with each successive player until amounts have been transferred between the bank and all other players or until the balance falls to zero.

Therefore, in the Big Ride wagering option, the amount to be transferred to the winner between the bank and another player is the lesser of the amounts placed in opposition therebetween. The balance is placed in opposition by the bank, while a wager is placed in opposition by each of the other players. In the Big Ride option, the amount to be transferred may hereinafter be referred to as the bet. The bank's balance against first action is the same as the bank's wager since no amounts have yet been won or lost.

For example, if the bank's wager is $50 and all other players wager $40, the bet between the bank and first action is $40. If first action is the winner therebetween, $40 is transferred from the bank to first action, leaving a balance of $10. The bet between the bank and the first successive player (to first action) is $10. If that player is the winner against the bank, the bet is transferred from the bank to that player. This leaves a zero balance and the round ends. Alternatively, if the bank won against first action, the balance would be $90 and the bet between the bank and the player succeeding first action would be the lesser of the balance and the succeeding player's wager, i.e., $40.

If there were 8 players including the bank and, in the example above, the bank had won against each of the other players, the balance at the end of the round would be $330. That is, $40 would have been transferred to the bank from each of the other players and added to the bank's wager of $50. If instead, the bank won against the first three players and lost against the fourth, the balance would be $170 when the bank opposed the fourth player. The bet with the fourth player would then be the lesser of $170 and $40, which would be $40. After the loss to the fourth player, the balance would be $130.

Therefore, in the Big Ride process, the bank's wager plays against each successive player's wager unless the bank, increased and decreased respectively by bank wins and losses, is exhausted (the balance equals zero). In the Big Ride, the bank will accumulate with each successive player that the bank wins against. In the Pan-9 process, the bank's wager is matched with successive player's wagers and the bank's possible increase is limited to the bank's wager. In both processes, the bank's loss is limited to his initial wager.

As in the Pan-9 wagering process, if a winner cannot be determined between the bank and another player because the game rules allow ties, no wagers are transferred therebetween. Such a player is not involved in that Big Ride round.

Following the Big Ride first round, the method illustrated in FIG. 3 has decision 64, which asks if the bank won the first round, i.e., he won more than he lost against other players—a net win. If the bank won the first round he must play a second Pan-9 bank, after which the bank passes to the succeeding player as respectively indicated in process 62 and terminator 72.

In this second Pan-9 bank, the bank must wager an amount at least as great as his final balance in process 68, i.e., his first round wager plus his net win. This means that all or a portion of the final balance of process 68 may be matched by wagers of the other players in the second round. This gives them an opportunity to win back their wagers and also offers the bank an opportunity to increase his winnings further. In game idiom, the bank may be said to have taken "The Big Ride" if he wins both the first Big Ride round and the second Pan-9 round.

If the answer to decision 64 is negative, i.e., the bank lost more than he won—a net loss in process 68, the bank moves to decision 74, which offers third and fourth wagering options respectively comprising playing a second Pan-9 bank (process 76) or passing the bank to the succeeding player (terminator 78). If the bank plays a second Pan-9 round, the bank is then passed in process 80. The same third and fourth wagering options are offered to the bank after process 60 as shown by decision 82, process 84 and terminators 86, 88.

The preferred method embodiment, described with reference to FIGS. 1, 3 and 4, offers several wagering options to game players which may lead to the involvement of more players in each game round. In the first wagering option, the bank is involved (in determining winners and transferring wagers) only with those successive players, beginning with first action, whose combined wagers are less than or equal to the bank's wager. Against those players, the bank may win or lose only as much as his wager.

However, in the second wagering option (The Big Ride), the bank continues to be involved (in determining winners and transferring wagers) with successive players until a winner has been determined between the bank and each of the other players or his net loss equals his wager. Wins and losses of the bank are respectively added to and subtracted from his wager to form his balance. Against those involved players, the bank's net win may be as much as their combined wager and his net loss only as much as his wager.

More players are generally involved in the Big Ride wagering option. In addition, the size of the bank's wager in the second round following a first Big Ride round win increases since the first round wager plus the net win of the first round must be wagered by the bank in the second round. These features of the Big Ride increase player excitement and enjoyment and offer greater income to the cardroom since more action is involved.

In the Pan-9 wagering process, wagers are provided by each of the game players and amounts equal to matched portions of the bank's wager are transferred from losers to winners. In the Big Ride wagering process, wagers are provided by each of the game players and amounts equal to bets calculated as the lesser of the bank's balance and opposing players' wagers are transferred from losers to winners. Although the wagers and the amounts transferred in these processes can be money, they preferably are money substitutes such as tokens or chips, which can be redeemed for money.

In cardrooms where the method embodiments may be practiced, it is customary for wagers, in the form of redeemable chips, to be physically placed in designated betting areas as shown on the game table 20 of FIG. 1. It is also customary to indicate in some manner which players have won and lost against the bank as the determination of winners progresses successively around the game table. For example, a player's chips may be left next to his upturned cards to indicate a win, while the chips may be placed over his downturned cards to indicate a loss. In case of a tie, the chips are typically returned to the player. After all winners have been determined, the chips are physically transferred from losers to winners.

To inform other players of his choice amoung wagering options, the bank orients the symbol 30 to display indicia "The Big Ride" as shown in FIG. 2A or to display (if the game played is Super Pan-9) "Dealer Pan-9" as shown in FIG. 2B.

If the invention is being practiced with a different game such as Asian Poker (a game well known in California cardrooms), the indicia in FIG. 2B would change accordingly, e.g., "Dealer Asian Poker", and the phrase "Pan-9" in the flow chart of FIG. 3 would change to "Asian Poker".

Sources, well known in the art, of Super Pan-9 and Asian Poker game rules include Mason Malmuth, *The Gambling Theory and Other Topics* (Las Vegas: Mason Malmuth, © 1990); Bill Zender, *Pai Gow Poker* (Las Vegas: Bill Zender, © 1991); Stanford Wong, *Optimal Strategy for Pai Gow Poker* (La Jolla: Pi Yee Press, © 1992); George Allen, *How to Play Pai Gow Poker* (Tempe: George Allen, © 1988); and Mike Caro, *Caro's Professional Pai Gow Poker Report and Banker Guidelines* (Las Vegas: Mike Caro, © 1986).

Cardroom rules often permit wagers from others who are not seated players. Such wagering players typically stand behind the seated players and place wagers on the outcome between seated players. For example, such a person might wager that the player in seat **22*h* of FIG. 1 will win against the bank. The wager may be placed in a separately marked portion of the betting area proximate to chair 22*h***. Such wagers are usually called "backline" wagers.

It is common to limit the number of backline players wagering on a particular seated player to two and order them in accordance with the time they placed their respective wagers. If two backline players were to wager in favor of the player in chair **22*h***, a winner is first determined between the bank and that seated player and an amount transferred therebetween as dictated by the wagering options described above. This process is then repeated with the first backline player, after which it is repeated with the second backline player. Finally, the process moves on to the succeeding seated player. That is, when backline players are permitted and they participate in a round, they are inserted into the successive order of players for that particular round.

On the other hand, the wagers of non-seated players may, with approval of the seated player, be combined with his wager. In this case, they are often referred to as "Kum-Kum" wagers and the combined wager is generally treated as though it were a single wager against the bank. In addition, cardroom rules usually permit a backline player, but not a "Kum-Kum" player, to make decisions concerning the play of the seated player's hand during the round in which they are participating if the backline's wager exceeds that of the seated player.

From the foregoing, it should now be recognized that a method has been disclosed herein especially suited for increasing player interest and involvement in wagering games by offering added wagering options. The teachings of the invention are applicable to any game defining sequences which determine a winner between game players.

The preferred embodiments of the invention described herein are exemplary and numerous modifications and rearrangements can be readily envisioned to achieve an equivalent result, all of which are intended to be embraced within the scope of the appended claims.

What is claimed is:

1. A method of apportioning wagers between a plurality of game players arranged in successive order, the method comprising the steps of:

specifying a first one of said players;

specifying a second one of said players;

defining a first wagering process having the steps of;

a) providing, from each of said game players, a wager;

b) conducting a game round, c) initiating an unmatched portion equal to the first player's wager;

d) matching a portion of the first player's wager against the second player's wager wherein said portion equals the lesser of said unmatched portion and said second player's wager or equals either of them if they are identical;

e) determining a winner in said game round between said first and second players;

f) transferring an amount equal to said portion from said second player to said first player if said first player is said winner and from said first player to said second player if said second player is said winner;

g) modifying said unmatched portion by subtracting therefrom said portion; and h) repeating the combination of said matching, determining, transferring and modifying steps with a different one of said players, excluding said first player, replacing, in successive order, said second player in each repetition, until the first occurs of (1) said transferring step has been completed between said first player and all other players and (2) said unmatched portion equals zero;

defining a second wagering process having the steps of;

a) providing, from each of said game players, a wager;

b) conducting a game round;

c) initiating a balance equal to the first player's wager;

d) establishing a bet equal to the lesser of said balance and the second player's wager or equal to either of them if they are identical;

e) determining a winner in said game round between said first and second players;

f) transferring an amount equal to said bet from said second player to said first player if said first player is said winner and from said first player to said second player if said second player is said winner;

g) modifying said balance by adding said bet to it if said first player is said winner and subtracting said bet from it if said second player is said winner;

h) repeating the combination of said establishing, determining, transferring and modifying steps with a different one of said players, excluding said first player, replacing, in successive order, said second player in each repetition, until the first occurs of (1) said transferring step has been completed between said first player and all other players and (2) said balance equals zero;

offering first and second wagering options to said first player for selection therebetween wherein said first wagering option includes the step of executing said first wagering process on a first game round; and wherein said second wagering option includes the step of executing said second wagering process on a first game round; and implementing the selected one of said first and second wagering options.

2. The method of claim 1 wherein said second wagering option further includes the step of executing said first wagering process on the succeeding game round if, at the conclusion of said second wagering process, said modifying step causes said balance to exceed said first player's wager.

3. The method of claim 2 wherein said second wagering option further includes the step of requiring a first player's wager, in said succeeding game round, to be at least as large as said balance at the conclusion of said second wagering process.

4. The method of claim 3 wherein said wager in said providing steps, said amount in said first wagering process and said amount in said second wagering process each comprise money.

5. The method of claim 3 wherein said wager in said providing steps, said amount in said first wagering process and said amount in said second wagering process each comprise a money substitute.

6. The method of claim 2 wherein said second wagering option further includes, after said executing step, the step of passing said specification of first player to the succeeding player.

7. The method of claim 1 further including, after said implementing step, the steps of:

offering, if said first wagering option was selected or if said second wagering option was selected and said modifying step at the conclusion of said second wagering process causes said balance to be less than said first player's wager, third and fourth wagering options to said first player for selection therebetween;

wherein said third wagering option includes the step of executing said first wagering process on the succeeding game round; and wherein said fourth wagering option includes the step of passing said specification of first player to the succeeding player; and implementing the selected one of said third and fourth wagering options.

8. The method of claim 7 wherein said third wagering option further includes, after said executing step, the step of passing said specification of first player to the succeeding player.

9. The method of claim 1 wherein said offering step is preceded by a step of offering to said first player the option of passing said specification of first player to the succeeding player.

10. The method of claim 1 wherein said game comprises Super Pan-9.

11. The method of claim 1 wherein said game comprises Asian Poker.

12. The method of claim 1 further comprising the steps of:

displaying proximate to said first player a symbol associated therewith to identify said first player to other of said players wherein said symbol bears first and second indicia respectively associated with said first and second wagering options; and orienting said symbol to display said first indicia if said first wagering option is selected and to display said second indicia if said second wagering option is selected.

13. A method of apportioning wagers between a plurality of game players arranged in successive order, the method comprising the steps of:

specifying a first one of said players;

specifying a second one of said players;

providing, from each of said game players, a wager;

conducting a game round;

initiating a balance equal to the first player's wager;

establishing a bet equal to the lesser of said balance and the second player's wager or equal to either of them if they are identical;

determining a winner in said game round between said first and second players;

transferring an amount equal to said bet from said second player to said first player if said first player is said winner and from said first player to said second player if said second player is said winner;

modifying said balance by adding said bet to it if said first player is said winner and subtracting said bet from it if said second player is said winner; and repeating the combination of said establishing, determining, transferring and modifying steps with a different one of said players, excluding said first player, replacing, in successive order, said second player in each repetition, until the first occurs of (1) said transferring step has been completed between said first player and all other players and (2) said balance equals zero.

14. The method of claim 13 wherein said wager in said providing step and said amount in said transferring step each comprise money.

15. The method of claim 13 wherein said wager in said providing step and said amount in said transferring step each comprise a money substitute.

* * * * *